United States Patent [19]

Neubauer

[11] 4,361,269

[45] Nov. 30, 1982

[54] TENTLESS CONTINUOUS MAILER ASSEMBLY

[75] Inventor: Frank Neubauer, Mt. Kisco, NY

[73] Assignee: Transkrit Corporation, Elmsford, N.Y.

[21] Appl. No.: 200,405

[22] Filed: Oct. 24, 1980

[51] Int. Cl.[3] ..... B65D 21/10

[52] U.S. Cl. ..... 229/69

[58] Field of Search ..... 229/69; 282/11.5 A, 282/11.5 R, 25

[56] References Cited

U.S. PATENT DOCUMENTS

| | | | |
|---|---|---|---|
| 3,339,827 | 9/1967 | Steidinger | 229/69 |
| 3,554,438 | 6/1968 | Van Malderghem | 229/69 |
| 3,777,971 | 12/1973 | Steidinger | 229/69 |
| 3,837,565 | 9/1974 | Johnsen | 229/69 |
| 4,050,582 | 9/1977 | Kalve | 229/69 |
| 4,095,695 | 6/1978 | Steidinger | 229/69 |
| 4,108,352 | 8/1978 | Peschke | 229/69 |
| 4,178,018 | 12/1979 | Halse | 282/11.5 A |
| 4,277,016 | 7/1981 | Wakeman et al. | 229/69 |

*Primary Examiner*—Stephen P. Garbe
*Attorney, Agent, or Firm*—Kenyon & Kenyon

[57] ABSTRACT

The front and back plies of the continuous mailer assembly are secured together by a hot melt pressure sensitive adhesive. This adhesive secures the plies together in a fixed permanent relation. When the assembly is unfolded from a zig zag stack, "tenting" is eliminated.

11 Claims, 3 Drawing Figures

TENTLESS CONTINUOUS MAILER ASSEMBLY

This invention relates to a tentless continuous mailer assembly.

As is known, various attempts have been made to manufacture continuous mailer assemblies and similar business forms of multiple plies in a manner in which the assemblies can be folded into a "zig zag" pack for shipment purposes and thereafter unfolded from the pack without having "tenting" occur. In this respect, it has been found that "tenting" occurs due to the manner in which the various plies of material are brought together and secured to each other. For example, in the past, continuous plies of material have been brought together and secured to each other via glues or adhesives which set, or bond permanently, at some point after bringing of the plies together. Traditionally, use has been made of a cold adhesive for securing the front and back plies together. However, a final set, or permanent bond, does not take place until many minutes after the plies have been folded into a zig-zag pack. As a result, the set adhesive tends to retain the plies in a fixed condition relative to each other so that when the assembly is subsequently unfolded, a peak or "tent" appears at the folds of the assembly where the various plies are secured together.

"Tenting" presents a problem since the continuous assemblies are usually provided with a series of control line holes along the marginal edges for registration with pinwheels in the automated equipment frequently used for processing the assemblies. Thus, if a "tent" occurs in an assembly moving through a piece of automated equipment, registration of the pins with the control line holes may not be obtained. As a result, it is possible for the assembly to lift away from the automatic equipment causing jamming, or a "forms check". Also, "tenting" might cause a pick-up of the edges of the assembly plies about the tent to such an extent that the assembly can be torn by the automated equipment. Damage to the print mechanism can also occur.

One known attempt to avoid "tenting" in a continuous business form is described in U.S. Pat. No. 4,108,352. In this case, the business form is made up of plies of material which are held together via glue with the intermediate plies being completely severed along adjacent edges in order to eliminate a bend in the intermediate ply at the fold of the assembly. However, such attempts require additional manipulation of the various plies of material during fabrication of the continuous assembly and the need for cutting tools and the like.

On occassion, use has also been made of a hot melt adhesive in an effort to reduce tenting in continuous mailers of paper. In this case, the hot melt adhesive is applied to one paper ply through an apparatus which is typically heated in a temperature range of 300° F. to 400° F. As soon as the hot melt adhesive contacts the paper, the adhesive begins to cool off. The "open time" (i.e. the period in which the adhesive is still hot and able to adhere to another ply of paper) is counted in fractions of one second. If the adhesive does not achieve a bond in this time, the adhesive, having cooled off, no longer bonds to the other ply of paper. Hence, a hot melt adhesive is highly unreliable and is not practical for bonding plies of paper together in a continuous mailer.

Accordingly, it is an object of the invention to provide a continuous mailer assembly which does not tent upon unfolding from a stacked array.

It is another object of the invention to provide a relatively simple technique of making a tentless mailer assembly.

It is another object of the invention to provide a tentless continuous mailer assembly which can be fabricated in relatively simple steps in a rapid manner.

Briefly, the invention provides a continuous mailer assembly, which is composed of a plurality of interconnected envelopes each of which is comprised of a front ply, a back ply and at least one line of hot melt pressure sensitive adhesive between the plies and securing the plies together. In addition, each envelope may include one or more insert plies between the front and back plies. These insert plies can be sized to fit between the line or lines of hot melt pressure sensitive adhesive and may be used to form return mail envelopes. Additional transverse lines of the adhesive can also be applied to form a rectangular frame about the insert plies.

The adhesive is a hot melt pressure sensitive adhesive as the term is known in the art which is, for example, a Fuller #HM-1089-B.

The invention also provides a method of making a tentless mailer assembly which is comprised of the steps of generating two continuous plies of paper, applying a hot melt pressure sensitive adhesive onto one of the plies in a temperature range of about 300° F. to 400° F. to bond the adhesive thereto and thereafter bringing the plies together to adhere the second ply to the adhesive and to the first ply in a fixed permanent relationship. The adhesive is applied in at least one longitudinal strip to the ply.

Additional plies may also be generated and collated between the two plies to form insert plies in known manner to form a mailer assembly. The continuous plies are thereafter provided with transverse lines of weakening so that a series of interconnected envelopes are formed. The assembly can then be subsequently stacked in zig-zag layers or packs as is conventionally done with continuous forms with at least one envelope per layer.

The hot melt pressure sensitive adhesive is characterized in that after its open time has ended, the adhesive remains very tacky and is still capable of adhering to another ply of paper at any time that the paper makes contact with the adhesive. Once contact is made, the bond is firm and permanent and the plies are no longer susceptible to shifting in a folded, e.g. a zig-zag condition. This is contrasted to the tendency for conventional cold adhesive which only achieves a bond after minutes of contact.

It is to be noted that the tack properties of the hot melt pressure sensitive adhesive can be modified so as to provide a secure bond to each of the plies.

These and other objects and advantages of the invention will become more apparent from the following detailed description and appended claims taken in conjunction with the accompanying drawings in which:

Figure 1:
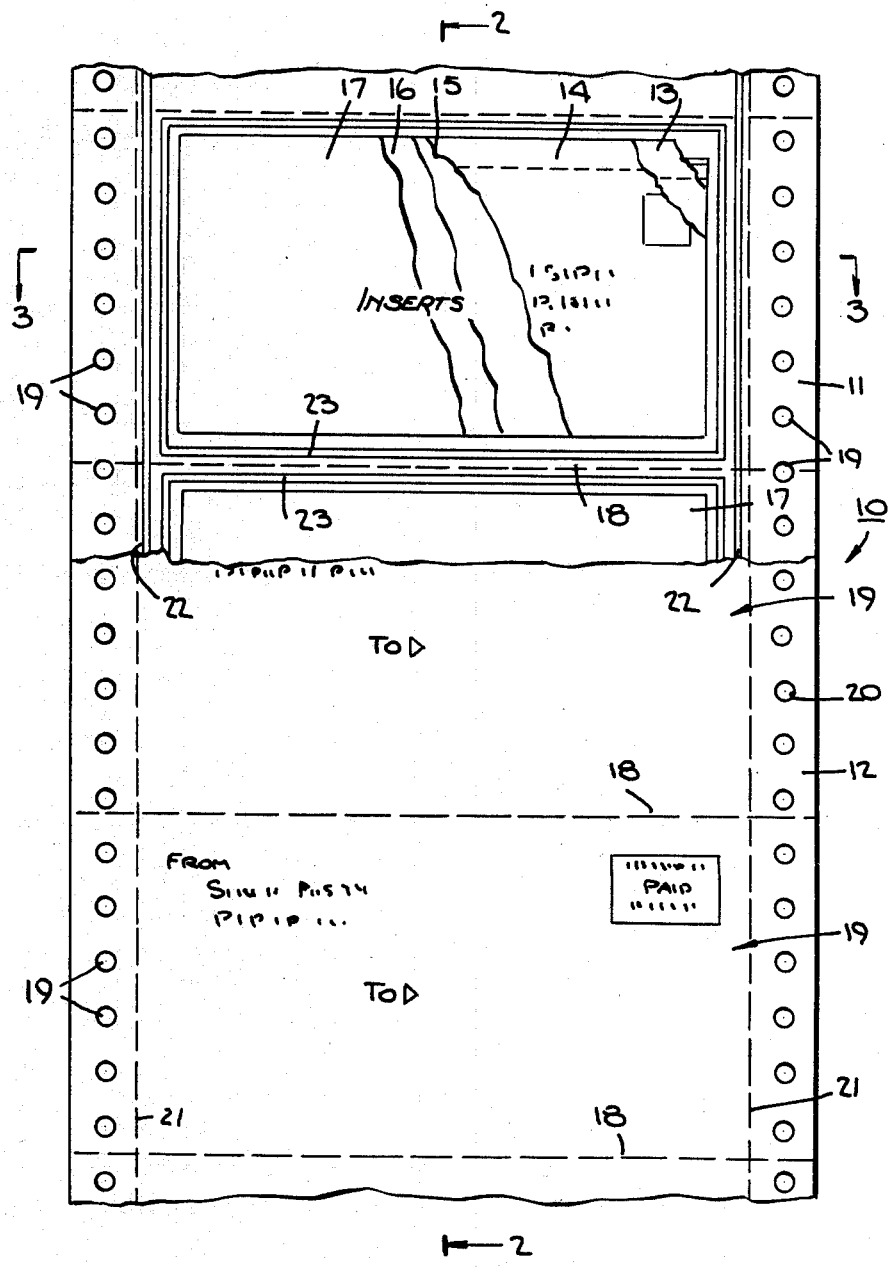
FIG. 1 illustrates a view of a continuous mailer assembly constructed in accordance with the invention.
Figure 2:
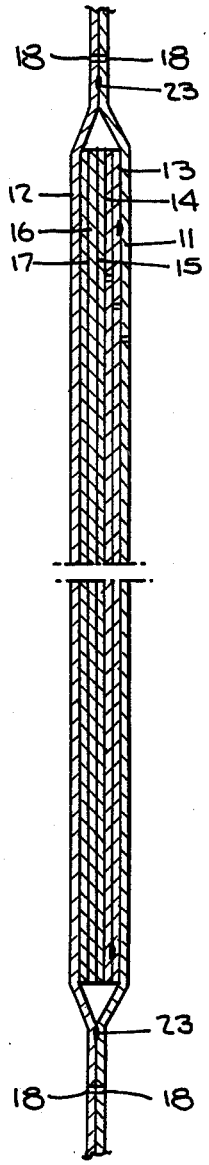
FIG. 2 illustrates a view taken on line 2—2 of FIG. 1.
Figure 3:
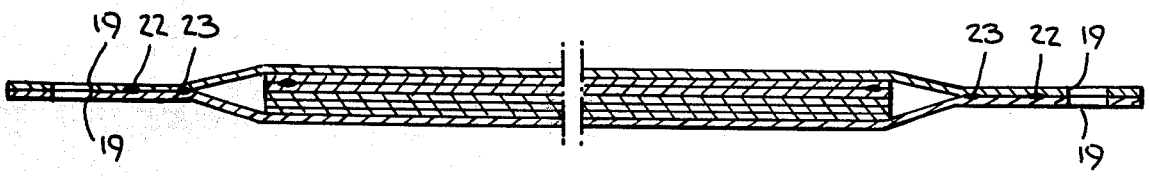
FIG. 3 illustrates a view taken on line 3—3 of FIG. 1.

Referring to FIG. 1, the continuous mailer assembly 10 is formed of a back ply 11, a front ply 12, and a plurality of insert plies 13–17 (see FIGS. 2 and 3). Each of the plies 11, 12 has a plurality of transverse lines of weakening 18 disposed in aligned relation so as to define a series of envelopes 19. In addition, the marginal edges of the assembly 10 are provided with overlying control line holes 20 in the front and back plies 11, 12 for processing in automated equipment. Suitable lines for weakening 21 are also provided along the marginal edges of the respective plies 11, 12 so that the strips containing the control line holes 20 can be subsequently removed from the assembly for purposes as is known.

As shown in FIG. 1, the insert plies 13–17 for each envelope 19 are of smaller dimension than the front and back plies 11, 12. These insert plies 13–17 are collated and held together in known manner relative to the front and back plies 11, 12.

The mailer assembly 10 also has two lines of hot melt pressure sensitive adhesive 22 securing the front and back plies 11, 12 together. The hot melt pressure sensitive adhesive is of any suitable type such as a Fuller #HM-1089-B.

In addition, the assembly may have a frame 23 formed by four lines of cold adhesive between the front and back plies 11, 12 and peripherally about the inserts 13–17 to further adhere the front and back plies 11, 12.

The characteristics of the hot melt pressure sensitive adhesive are such that the plies 11, 12 are permanently fixed with each other so that the assembly can be folded about the lines of weakening 18 into a stacked array containing, for example two envelopes per layer without a "tent" occurring upon unfolding of the assembly, for example for processing in automated equipment.

In order to make the tentless mailer assembly, two continuous plies of paper are generated to form the back and front plies 11, 12. In addition, additional plies of paper are generated and cut in known manner so as to provide the insert plies 13–17. These plies 11–17 are collated in suitable manner and a hot melt pressure sensitive adhesive is applied in a temperature range of about 300° F. to 400° F. to one of the plies, for example the back ply 11, to form the bonded-in lines. Thereafter, the plies 11, 12 (with the insert plies 13–17 therebetween) are brought together in order to adhere the lines of adhesive 22 to the front ply 12 to form a fixed permanent relationship between plies 11, 12. Subsequently, the transverse lines of weakening 18 can be formed in the plies 11, 12 in a conventional manner.

It is to be noted that the adhesive lines 22 are applied in parallel relationship with the inserts 13–17 sized to fall within the confines of the lines 22. In addition, the frame 23 of cold adhesive can be applied for example to the back ply 11, about the insert plies 13–17 for each envelope 19. When the front and back plies are brought together, the frame 23 is then adhesively secured to the front ply 12. This may also be done with hot melt pressure sensitive adhesive.

The front and back plies 11, 12 of a continuous mailer may also be secured together using a single line of the hot melt pressure sensitive adhesive. In this regard, it has been found that a single line while not as effective as two or more lines does eliminate a significant amount of the "tenting" problems in continuous mailers.

The invention thus provides a continuous mailer assembly which eliminates tenting of the interconnected envelopes of the assembly when unfolded from a zigzag pack. In this regard, the fixed permanent relationship afforded by the hot melt pressure sensitive adhesive between the front and back plies prevents these plies from shifting relative to each other when folded into a stacked array.

The continuous mailer may be constructed in various manners. For example, the insert plies may be used to form a return mail envelope, for example as described in U.S. Pat. No. 4,157,759.

The invention further provides a continuous mailer assembly which can be assembled in a rapid manner without using cumbersome cutting blades or tools to effect lines of weakening within the plies to avoid tenting.

What is claimed is:

1. In a continuous mailer assembly, the combination comprising a first ply having a plurality of transverse lines of weakening to define a series of envelope fronts;

a second ply having a plurality of transverse lines of weakening to define a series of envelope backs; and at least one line of hot melt pressure sensitive adhesive between said plies and securing said plies together, said adhesive being characterized in that after its open time has ended, said adhesive remains very tacky and is capable of adhering to another ply of paper at any time that the paper makes contact with said adhesive.

2. The combination as set forth in claim 1 wherein said adhesive is a Fuller #HM-1089-B.

3. The combination as set forth in claim 1 which further comprises at least one series of inserts between said plies, each said insert being disposed between a respective envelope back and an opposed envelope front.

4. The combination as set forth in claim 3 wherein each respective insert is peripherally free of said respective envelope back and front on at least one side thereof.

5. The combination as set forth in claim 1 which includes two lines of said hot melt pressure sensitive adhesive between said plies in parallel and longitudinal of said assembly.

6. A stacked array of interconnected envelopes disposed in layers of at least one envelope per layer; each said envelope comprising a front ply;

a back ply, and at least one line of hot melt pressure sensitive adhesive securing said front ply to said back ply, said adhesive being characterized in that after its open time has ended said adhesive remains very tacky and is capable of adhering to another ply of paper at any time that the paper makes contact with said adhesive.

7. A tentless mailer assembly comprising a plurality of interconnected envelopes, each said envelope comprising a front ply, a back ply and at least one line of hot melt pressure sensitive adhesive securing said front ply to said back ply, said adhesive being characterized in that after its open time had ended, said adhesive remains very tacky and is capable of adhering to another ply of paper at any time that the paper makes contact with said adhesive.

8. A tentless mailer assembly as set forth in claim 7 wherein said adhesive is a Fuller #HM-1089-B.

9. A tentless mailer assembly as set forth in claim 7 wherein each said envelope includes at least one insert between said front ply and said back ply.

10. In a continuous mailer assembly, the combination comprising a first ply having a plurality of transverse lines of weakening to define a series of envelope backs;

at least one series of inserts between said plies, each said insert being disposed between a respective envelope back and an opposed envelope front and being peripherally free of said respective envelope back and front on at least one side thereof; a frame of cold adhesive between a respective back and front and peripherally about said insert therebetween; and at least one line of hot melt pressure sensitive adhesive between said plies and securing said plies together.

11. A tentless mailer assembly comprising a plurality of interconnected envelopes, each said envelope comprising a front ply, a back ply, at least one insert between said front ply and said back ply, a frame of cold adhesive peripherally about said insert and securing said back ply to said front ply of each envelope to each other, and at least one line of Fuller #HM-1089-B hot melt pressure sensitive adhesive securing said front ply to said back ply.

* * * * *